United States Patent [19]

Walega

[11] 4,205,409

[45] Jun. 3, 1980

[54] PULLING OVER AND LASTING ARRANGEMENT

[75] Inventor: William Walega, Hollis, N.H.

[73] Assignee: International Shoe Machine Corporation, Nashua, N.H.

[21] Appl. No.: 969,918

[22] Filed: Dec. 15, 1978

[51] Int. Cl.[2] ..... A43D 21/00

[52] U.S. Cl. ..... 12/10.5; 12/14.5

[58] Field of Search ..... 12/10.1, 10.5, 14.5, 12/9, 10.2, 10.21, 10.3, 10.4, 145

[56] References Cited

U.S. PATENT DOCUMENTS

| | | | |
|---|---|---|---|
| 3,359,584 | 12/1967 | Becka et al. | 12/10.5 |
| 3,397,417 | 8/1968 | Kamborian | 12/10.5 |
| 3,626,533 | 12/1971 | Den Benken et al. | 12/10.5 |

*Primary Examiner*—Patrick D. Lawson
*Attorney, Agent, or Firm*—Albert Gordon

[57] ABSTRACT

A pulling over arrangement on a pulling over and lasting machine. The pulling over arrangement comprises a pincers that is operable to grip the margin of an upper and is movable downwardly under the yieldable force of an air operated motor. A locking mechanism is provided that locks the pincers against upward movement after the pincers have been moved downwardly and a release means is provided to release the locking mechanism.

4 Claims, 5 Drawing Figures

PULLING OVER AND LASTING ARRANGEMENT

BACKGROUND OF THE INVENTION

A prior pulling over and lasting machine is disclosed in each of U.S. patent applications Ser. Nos. 932581 and 932596, both filed on Aug. 10, 1978. This prior machine incorporates wipers and wiper mounting and operating means similar to that disclosed in U.S. Pat. No. 3397417. The prior machine comprises: a support for supporting bottom-down a shoe assembly that includes a last having an upper mounted thereon and an insole located on its bottom; means mounting the support for heightwise movement; a pair of wipers mounted for forward translatory movement from a rearward out-of-the-way position to a forward wipers working position and for forward and inward movement in a wiping stroke from the forward wipers working position; a pincers located outwardly of the support, movable between open and closed positions, mounted for heightwise movement; yieldable force applying means for effecting the heightwise movement of the pincers; means for initially retaining the support in a support lower position wherein the top of the support is below the top of the wipers; means for initially retaining the wipers in their rearward out-of-the-way position; means for initially retaining the pincers in its open position; means for initially causing the force applying means to retain the pincers in a pincers upper position wherein the pincers are above the level of the wipers; means for thereafter moving the pincers into its closed position to grip the upper margin; means for thereafter causing the force applying means to lower the pincers to a pincers working position that is determined by the resistance to stretching of the upper margin and that is below the bottoms of the wipers; means for thereafter raising the support from the support lower position to a support upper position wherein the top of the support is approximately at the level of the tops of the wipers; means, operative after the force applying means has lowered the pincers to the pincers working position, to move the wipers to the wipers working position wherein the wipers are close to the periphery of the insole and are above the pincers; means for thereafter imparting a wiping stroke to the wipers to enable the wipers to wipe the upper margin against the insole; means, effective prior to the completion of the wiping stroke, for returning the pincers to its open position to enable the pincers to release the upper margin; means for thereafter moving the wipers rearwardly to return the wipers to thier rearward out-of-the-way position wherein the wipers are not above the pincers; and means, effective when the wipers are no longer above the pincers, for causing the force applying means to raise the pincers to the pincers upper position.

SUMMARY OF THE INVENTION

The raising of the support from the support lower position to the support upper position, while the pincers is in the pincers working position and is gripping the upper margin, enables the upper to be stretched about the last preparatory to the wiping of the upper margin against the insole. It has been found that there is a tendency, during the rise of the support, for the pincers to move upwardly of the pincers working position against the yieldable force of the force applying means to a level that is above the bottoms of the wipers which, undesirably, causes the wipers to engage the pincers during the movement of the wipers from their rearward out-of-the-way position to the wipers working position. In order to prevent this engagement of the wipers with the pincers the prior machine has been improved, in accordance with this invention, by adding to it: a locking mechanism, effective when the pincers is in the pincers working position, to lock the pincers against upward movement beyond an intermediate position below the level of the bottoms of the wipers that is between the pincers working position and the pincers upper position, the pincers in its intermediate position being lower than the level of the bottoms of the wipers; and release means effective, after the wipers have moved rearwardly so as to no longer be above the pincers, to release the locking mechanism to enable the force applying means to move the pincers upwardly of the intermediate position to the pincers upper position.

DESCRIPTION OF THE PREFERRED EMBODIMENT

Figure 1:
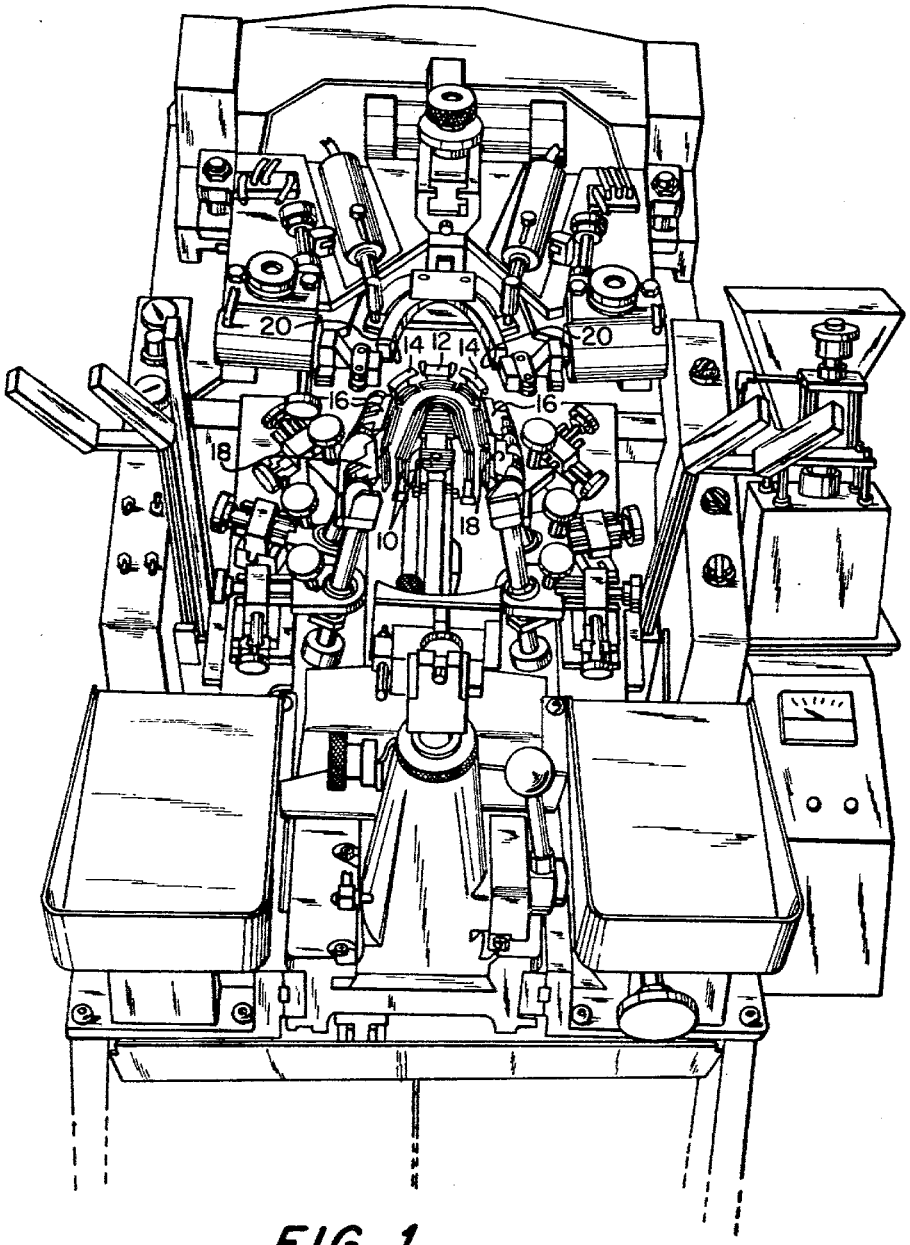
FIG. 1 is a front view of the machine.

The operator is intended to stand in front of the machine as seen in FIG. 1. Machine parts closest to the operator are considered to be at the front of the machine and machine parts furthermost from the operator are considered to be at the back of the machine. Parts moving towards the operator are considered to have "forward" movement and parts moving away from the operator are considered to have "rearward" movement.

The machine is inclined for ease of presentation of shoe assemblies thereto. However, for ease of explanation, the plane of the top of an insole rest 10 (See FIG. 4) will be considered to be in a horizontal plane.

Referring to FIG. 1, the machine includes the insole rest 10. A toe pincers assembly 12 is located rearwardly of the insole rest 10 and side pincers assemblies 14 and 16 are located on each side of the insole rest 10 forwardly of and on each side of the toe pincers assembly 12. Ball pincers assemblies 18 are located on each side of the insole rest 10 and forwardly of the forepart pincers assemblies 16. Toe wipers 20 are, in the idle position of the machine, located rearwardly of the insole rest 10 and of the pincers assemblies 12, 14, 16 and 18 and are mounted for forward and inward movement in a horizontal plane. The pincers assemblies 12, 14, and 16 are constructed as shown in U.S. patent applications Ser. Nos. 932581 and 932596.

Figure 2:
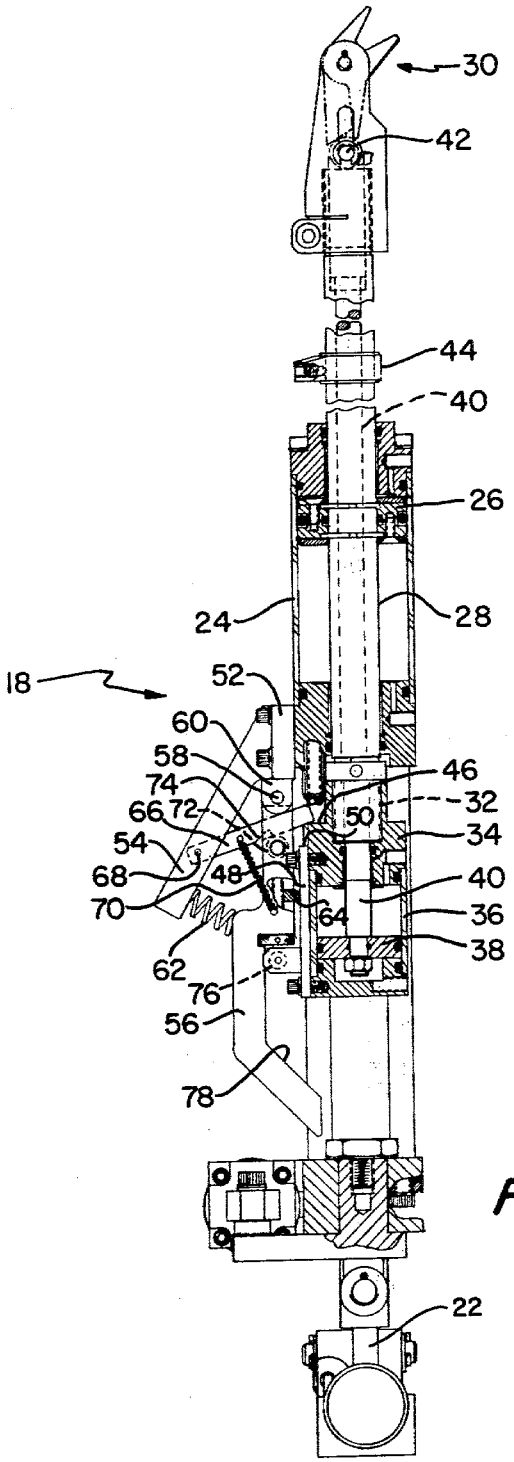
FIG. 2 is a partially sectional elevation of the pincers assembly that incorporates the pincers and the force applying means.

FIG. 2 shows one of the ball pincers assemblies 18. Each ball pincers assembly is mounted to a slide 22 that is mounted to the machine frame in the manner shown in U.S. patent applications Ser. Nos. 932581 and 932596. An air actuated motor 24, on each of the pincers assemblies 18, incorporates a piston 26 mounted for heightwise movement. Each piston 26 is affixed to a sleeve 28 also mounted for heightwise movement, and each sleeve 28 is mounted at its top to a pincers 30 formed of a pair of relatively movable jaws whereby heightwise movement of a piston 26 causes corresponding heightwise movement of its associated pincers 30. The bottom of each sleeve 28 is secured by a threaded connection 32 to a post 34 and the bottom of each post 34 forms the top portion of an air actuated motor 36 whereby each motor 36 is mounted for heightwise movement in unison with its associated sleeve 28. Each motor 36 incorporates a piston 38 and each piston 38 is affixed to a shaft 40 that is slidably mounted for heightwise movement within its associated post 34 and sleeve 28. A cam roll 42 on the top of each shaft 40 is adapted to close the normally open jaws of its associated pincers 30 in response to upward movement of its associated shaft 40 in the manner disclosed in U.S. Pat. No. 3902211. Each sleeve 28 is slidably guided for heightwise movement in a guide 44. The pincers assemblies 12, 14 and 16 each have pincers 30 at their upper ends.

An upwardly facing shoulder 46 is formed on each post 34. A plate 48 is mounted to each motor 36, the upper end of each plate 48 forming an upwardly facing shoulder 50 is below its associated shoulder 46. A flange 52, mounted to each motor 24, has a downwardly and outwardly depending leg 54. A lever 56 is pivoted by a pivot 58 to a clevis 60 on the flange 52. A spring 62 interposed between the leg 54 and the lever 56 yieldably urges the lever 56 inwardly towards the pincers assembly 18 about the axis of the pivot 58. A tooth 64 is mounted to the lever 56 and is adapted to bear against the plate 48 under the influence of the spring 62. A finger 66 is so pivoted to the leg 54 by a pivot 68 as to extend inwardly of the leg 54. A spring 70 interposed between the finger 54 and the lever 56 yieldably urges the finger 66 downwardly about the axis of the pivot pin 68. A pin 72 on the lever 56 is so dimensioned as to nest in a recess 74 in the bottom of the finger 66 in the manner described below. A cam follower 76 is mounted to the plate 48 and is adapted to bear against a downwardly and inwardly extending cam 78 at the bottom of the lever 56 in the manner described below.

Figure 3:
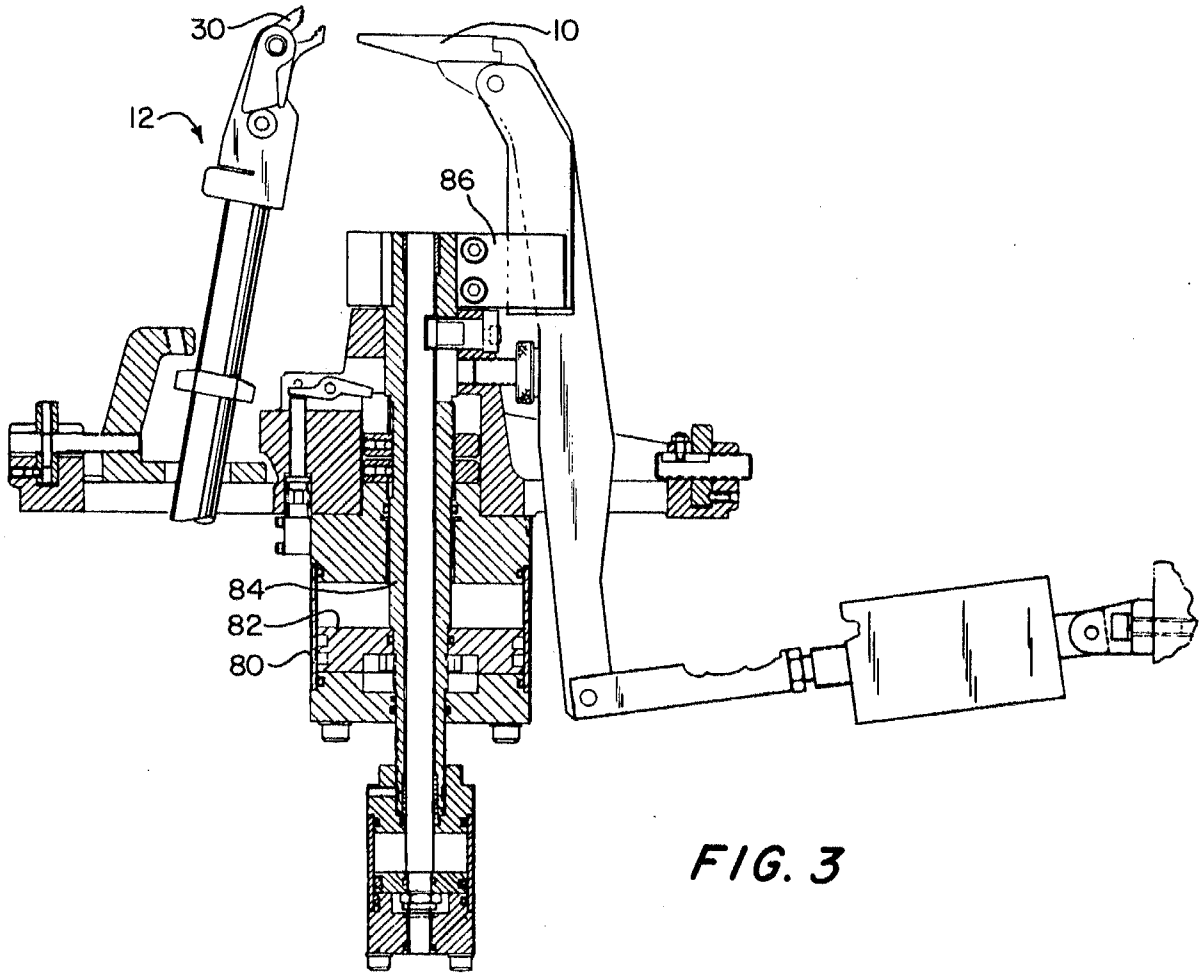
FIG. 3 is a partially sectional elevation of the support and the support raising means.

Referring to FIG. 3, an air operated motor 80, fixed to a stationary part of the machine, has a heightwise movable piston 82. The piston 82 is affixed to a sleeve 84 that, in turn, is affixed at its upper end to a collar 86. The insole rest 10 is affixed to the collar 86 whereby heightwise movement of the piston 82 causes corresponding heightwise movement of the insole rest 10.

In the idle condition of the machine: the pincers assemblies 12, 14, 16 and 18 are in upper positions so that the pincers 30 of all of the pincers assemblies are in raised positions, the ball pincers assemblies 18 being in the FIG. 2 position with their pincers 30 at higher elevations than the pincers of the pincers assemblies 12, 14 and 16 and above the level of the wipers 20 and with the pistons 26 being in upper positions in the motors 24; the pincers 30 of all of the pincers assemblies 12, 14, 16 and 18 are open with the pistons 38 being in lower positions in the motors 36; the fingers 66 are urged by the springs 70 against the shoulders 46; the springs 62 are urging the levers 56 inwardly with the teeth 64 bearing against the plates 48 below the shoulders 50; the cams 78 are located below and spaced from the cam followers 76; the piston 82 is in its lowered position in the motor 80, as shown in FIG. 3, so that the insole rest 10 is in a lower position with the top of the insole rest below the level of the tops of the wipers 20; and the wipers 20 are in rearward out-of-the-way positions.

Figure 4:
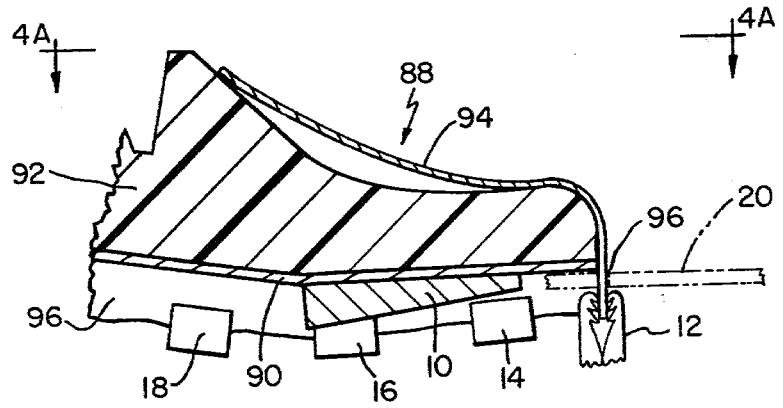
FIG. 4 is a representation in sectional elevation of the shoe assembly in the machine while the support is in the support upper position and the wipers are in the wipers working position.
Figure 4A:
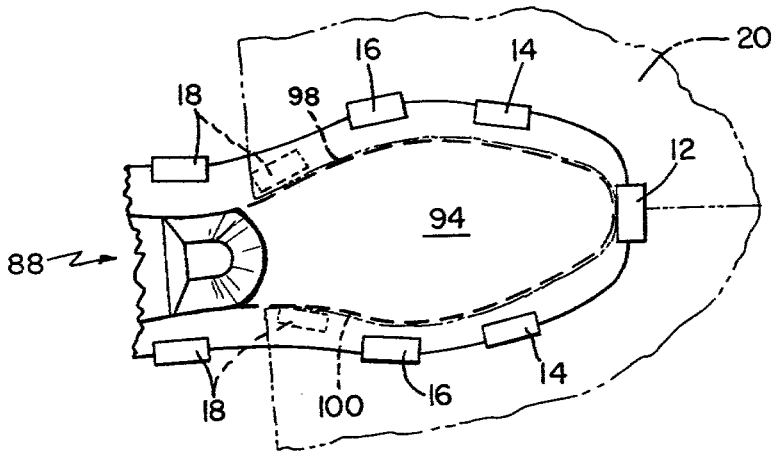
FIG. 4A is a view taken along the line 4A—4A of FIG. 4.

Referring to FIGS. 4 and 4A, a shoe assembly 88 is presented bottom-down to the machine. The shoe assembly 88 comprises a shoe insole 90 located on the bottom of a last 92 and a shoe upper 94 draped over the last. The operator inserts the toe portion of the upper margin 96 between the jaws of the pincers 30 of all of the pincers assemblies 12, 14, 16 and 18. The ball pincers assemblies 18 are to grip, as described below, the ball portions of the upper margin 96, which, as seen in FIG. 4, are at a higher elevation than the toe end and forepart portions of the upper margin which are to be gripped by the pincers assemblies 12, 14 and 16, and it is for this reason that the pincers 30 of the ball pincers assemblies 18 are initially located at higher elevations than the pincers 30 of the pincers assemblies 12, 14 and 16.

The pincers 30 of the pincers assemblies 12, 14, 16 and 18 are caused to grip the upper margin 96 and the pincers 30 of the ball pincers assemblies 18 are caused to be lowered. The pincers 30 of the ball pincers assemblies 18 are caused to grip the upper margin 96 by actuations of the motors 36 to raise the pistons 38, and are caused to be yieldably lowered under the force of pressurized air by actuations of the motors 24 to lower the pistons 26.

During the downward movement of the pincers 30 of the ball pincers assemblies 18, the motors 36 and the plates 48 move downwardly with the plates 48 moving downwardly of the teeth 64 until the shoulders 50 descend below the teeth 64 at which time the springs 62 force the levers 56 inwardly about the pivots 58 to move the teeth 64 inwardly of the shoulders 50. Also during the downward movement of the pincers 30 of the ball pincers assemblies 18, the shoulders 46 move downwardly with the springs 70 causing the inner ends of the fingers 66 to bear against the shoulders 46 with the fingers 66 swinging downwardly about the pivots 68. The pins 72 and the recesses 74 are so located that during this downward movement of the fingers 66 the recesses 74 are located outwardly of the pins 72 so that the pins 72 do not enter the recesses 74 but the bottoms of fingers 66 inward of the recesses 74 bear against the pins 72 when the shoulders 46 have lowered sufficiently for this to take place. The lowering of the ball pincers assemblies pincers 30 causes the ball portions of the upper margin 96 to be stretched about the last 92 and, due to the yieldable lowering force applied to these pincers by the air operated motors 24, this lowering movement terminates when the resistance to stretching of the upper margin 96 is greater than the downward stretching force applied by the motors 24.

Now the motor 80 is actuated by pressurized air to raise the piston 82, together with the insole rest 10, while the upper margin 96 is gripped by the pincers 30 of all of the pincers assemblies 12, 14, 16, and 18 to thereby cause the shoe assembly 88 to rise and cause the upper 94 to be stretched about the vamp of the last 92 with the insole rest 10 completing its rise when the top of the insole rest 10 is slightly above the level of the tops of the wipers 20 as indicated in FIG. 4. Any tendency of the rise of the insole rest 10 and the shoe assembly 88 to cause the pincers 30 of the ball pincers assemblies 18 to rise against the yieldable force of the pressurized air forcing the pistons 26 downwardly is prevented by the teeth 64 bearing against the shoulders 50. The pincers 30 of the ball pincers assemblies 18 are therefore retained, during the rise of the insole rest 10, at levels below the level of the wipers 20. This is followed, in the manner shown in U.S. patent applications Ser. Nos. 932581 and 932596, by inward and twisting movements of the ball pincers assemblies 18 to cause the pincers 30 of the ball pincers assemblies 18 to be located in the phantom position of FIG. 4A wherein they are close to and parallel to the sides of the last 92 heelward of the ball breaks 98 and 100.

The remainder of the machine cycle is similar to that disclosed in U.S. patent application Ser. No. 905683 filed May 15, 1978, in U.S. Pat. No. 3902211, and in British patent specification 1341967. The machine includes a slide plate, constructed similarly to the slide plate shown in U.S. Pat. No. 3397417, which carries the toe wipers 20 and which is mounted for forward-rearward movement. The slide plate is now moved forwardly to translate the wipers 20 forwardly from their rearward out-of-the-way position to a forward working position, shown in FIGS. 4 and 4A, wherein the wipers are close to the periphery of the insole 90. Because of the action of the teeth 64 bearing against the shoulders 50 in preventing the ball pincers assemblies pincers 30 from rising above the level of the bottoms of the wipers 20 pursuant to the rise of the shoe assembly 88 by the motor 80, the engagement of the ball pincers assemblies pincers 30 by the wipers 20 during the movement of the wipers 20 from their rearward out-of-the-way position to their forward working position is prevented. Following this forward movement of the slide plate, the shoe assembly 88 is clamped in position on the insole rest 10, adhesive is extruded onto the periphery of the toe portion of the insole 90 and the wipers 20 are moved forwardly and inwardly from their working position in a wiping stroke to engage the upper margin 96 and wipe it against the periphery of the insole 90 to thereby enable the adhesive to bond the wiped upper margin to the insole. During the wiping stroke, the pincers 30 of the pincers assemblies 12, 14, 16, and 18 are caused to release the upper margin 96 to enable the wipers 20 to effect the wiping operation without interference from the pincers. The pincers 30 of the pincers assemblies 18 are caused to release the upper margin 96 by so actuating the motors 36 as to cause downward movement of the pistons 38.

The release of the upper margin by the ball pincers assemblies pincers 30 relieves the resistance to downward movement of the ball pincers assemblies pincers 30 by the heretofore gripped upper margin 96 so that the pistons 26 are moved to the bottoms of the motors 24 carrying the ball pincers assemblies pincers 30 further downwardly. This further downward movement causes the posts 34 and the motors 36 to move further downwardly resulting in the cam followers 76 so engaging the cams 78 as to swing the levers 56 outwardly about the pivots 58 and thus move the teeth 64 outwardly of the shoulders 50. The outward movement of the levers 56 also enables the pins 72 to move into the recesses 74 of the fingers 66 with the springs 70 retaining the recesses 74 seated on the pins 72 to thereby latch the levers 56 in the outer positions into which they were swung by the cams 78.

At the end of the machine cycle, the wipers 20 are returned to their rearward out-of-the-way position wherein they are no longer above the pincers 30 and the motors 24 are actuated to raise the pistons 26 to their idle positions and thus raise the posts 34 and the motors 36 to their idle positions. Due to the latching of the levers 56 in their outer positions during these rises by the seating of the recesses 74 on the pins 72, the teeth 64 are located outwardly of the shoulders 50 and thus do not prevent the pistons 26 and the parts movable therewith from rising to their idle positions. As the pistons 26 near their idle positions, the shoulders 46 engage the levers 66 and raise them about the pivots 68 to thus unseat the recesses 74 from the pins 72 so that the springs 62 can swing the levers 56 inwardly about the pivots 58 with the teeth 64 engaging the plates 48 below the shoulders 50.

There follows a recapitulation of the description of those portions of the machine and its mode of operation that are germane to this invention.

The machine comprises the insole rest 10 which acts as a support for supporting bottom-down the shoe assembly 88 that includes the last 92 having the upper 94 mounted thereon and the insole 90 located on its bottom. The sleeve 84 acts as means mounting the support 10 for heightwise movement. The wipers 20, in the manner shown in U.S. Pat. No. 3397417, are mounted for forward translatory movement from their rearward out-of-the-way position to a forward wipers working position and for forward and inward movement in a wiping stroke from the forward wipers working position. A pincers 30, located outwardly of the support 10, is movable between open and closed positions in the manner shown in U.S. Pat. No. 3902211 and is mounted for heightwise movement by the sleeve 28. The air actuated motor 24 acts as yieldable force applying means for efffecting heightwise movement of the pincers 30. The motor 80 and the appropriate pneumatic circuitry, not shown, act as means for initially retaining the support 10 in a lower support position wherein the top of the support 10 is below the tops of the wipers 20. Means, similar to that shown in U.S. Pat. No. 3397417, initially retain the wipers 20 in their rearward out-of-the-way position. The motor 36 and the appropriate pneumatic circuitry, not shown, act as means for initially retaining the pincers 30 in its open position. The appropriate pneumatic circuitry for the force applying means 24, not shown, acts as means for initially causing the force applying means 24 to retain the pincers 30 in a pincers upper position wherein the pincers 30 are above the level of the wipers 20. The motor 36 and the appropriate pneumatic circuitry, not shown, act as means for thereafter moving the pincers into its closed position to grip the upper margin. The appropriate pneumatic circuitry for the force applying means, not shown, acts as means for thereafter causing the force applying means 24 to lower the pincers 30 to a pincers working position that is determined by the resistance to stretching of the upper margin and that is below the wipers 20. The motor 80 and the appropriate pneumatic circuitry, not shown, act as means for thereafter raising the support 10 from the lower support position to an upper support position wherein the top of the support 10 is approximately at the level of the tops of the wipers 20. Mechanisms shown in U.S. Pat. No. 3397417 act as means, operative after the force applying means 24 have lowered the pincers 30 to the pincers working position, to move the wipers 20 to the wipers working position shown in FIGS. 4 and 4A wherein the wipers 20 are close to the periphery of the insole 90 and are above the pincers 30. Mechanism shown in U.S. Pat. No. 3397417 acts as means for thereafter imparting a wiping stroke to the wipers 20 to enable the wipers 20 to wipe the upper margin 96 against the insole 90. The motor 36 and the appropriate pneumatic circuitry, not shown, act as means, effective prior to the completion of the wiping stroke, for returning the pincers 30 to its open position to enable the pincers 30 to release the upper margin 96. Mechanism shown in U.S. Pat. No. 3397417 acts as means for thereafter moving the wipers 20 rearwardly to return the wipers 20 to their rearward out-of-the-way position wherein the wipers 20 are not above the pincers 30. The appropriate pneumatic circuitry for the force applying means 24 acts as means, effective when the wipers 20 are no longer above the pincers 30, for causing the force applying means 24 to raise the pincers 30 to the upper pincers position. The machine is improved, in accordance with this invention, by providing a locking mechanism, effective when the pincers 30 is in the pincers working position, to lock the pincers 30 against upward movement beyond an intermediate position below the level of the bottoms of the wipers that is between the pincers working position and the pincers upper position, the pincers 30 in its intermediate position being lower than the level of the bottoms of the wipers 20, and by providing a release means effective, after the wipers 20 have moved rearwardly so as to no longer be above the pincers, to release the locking mechanism to enable the force applying means 24 to move the pincers upwardly of the intermediate position to the pincers upper position.

The flange 52 forms a non-heightwise movable upper housing. The plate 48 forms a part of a lower housing, located below the upper housing 52, mounted to the pincers 30 for heightwise movement therewith. The locking mechanism comprises: the lever 56 depending from the upper housing 52 so pivoted to the upper housing 52 as to have inward-outward movement with respect to the lower housing part 48; an upwardly facing shoulder 50 on the lower housing part 48; the spring 62 which acts as lever operating spring means yieldably urging the lever 56 towards the lower housing part 48; and the tooth 64 on the lever 56 so located as to bear against the lower housing part 48 below the shoulder 50 when the pincers 30 is in the upper pincers position and to be located above the shoulder 50 when the pincers 30 is in the pincers working position, the engagement of the tooth 64 with the shoulder 50 being determinative of the pincers intermediate position. The release means comprises latching means for latching the tooth 64 in a latched position outwardly of the shoulder 50 while the shoulder 50 is below the tooth 64 prior to causing the force applying means 24 to move the pincers 30 to the pincers upper position and unlatching means for unlatching the tooth 64 from its latched position so as to enable the lever operating spring means 62 to urge the tooth 64 against the lower housing part 48 when the pincers 30, together with the lower housing part 48, have been moved by the force applying means 24 sufficiently to raise the shoulder 50 above the tooth 64.

The machine is so constructed that the force applying means 24 lowers the pincers 30 downwardly of the pincers working position to a pincers lower position pursuant to the return of the pincers to the pincers upper position. The shoulder 50 is a lower shoulder and the post 34 forms a part of the lower housing. The latching means and unlatching means comprise: an upper shoulder 46 on the lower housing part 34 located above the lower shoulder 50; the leg 54 depending from the upper housing 52 and extending outwardly of the lever 56; the finger 66 pivoted to the leg 54 for heightwise movement and extending towards the lower housing part 34, the finger 66, and the lower housing part 34 being so constructed and arranged that the finger 66 rests on the upper shoulder 46 when the pincers 30 is in the upper pincers position; finger operating springs means, in the form of the spring 70, yieldably urging the finger 66 downwardly against the upper shoulder 46; the recess 74 in the bottom of the finger 66; the pin 72 on the lever 56 so constructed as to be seated in the recess 74 when the pin and the recess are in alignment, the pin and the recess being so constructed and arranged that the pin is inward of the recess when the tooth 64 is bearing against the lower housing part 48; and the cam 78, mounted to the lever 56, and the cam follower 76, mounted to the lower housing part 48, so constructed and arranged as to cause the cam and the cam follower to coact to swing the lever 56 outwardly away from the lower housing 34, 48 in response to the lowering of the pincers 30 to the pincers lower position and a corresponding lowering of the lower housing 34, 48, outward swinging of the lever 56 enabling the pin 72 to be seated in the recess 74 and to be retained so seated by the finger operating spring means 70; the raising of the pincers 30 to the pincers upper position and the corresponding raising of the lower housing 34, 48 causing the upper shoulder 46 to engage the finger 66 and swing the finger upwardly so as to raise the recess 74 upwardly of the pin 72 and thereby enable the lever operating spring means 62 to again swing the lever 56 inwardly so as to cause the tooth 64 to bear against the lower housing part 48 below the lower shoulder 50.

I claim:

1. A pulling over arrangement for gripping a workpiece portion and moving the gripped workpiece portion heightwise comprising: a pincers, movable between open and closed positions, mounted for heightwise movement; yieldable force applying means for effecting said heightwise movement; means for initially retaining the pincers in its open position; means for initially causing the force applying means to retain the pincers in a pincers upper position; means for thereafter moving the pincers into its closed position to cause it to grip the workpiece portion; means for thereafter causing the force applying means to lower the pincers to a pincers working position that is determined by the resistance to stretching of the workpiece; means for thereafter returning the pincers to its open position to enable the pincers to release the workpiece portion; and means for thereafter causing the force applying means to raise the pincers to the pincers upper position; characterized in that the arrangement comprises: a locking mechanism effective, when the pincers is in the pincers working position, to lock the pincers against upward movement beyond an intermediate position that is between the pincers working position and the pincers upper position; and release means effective to release the locking mechanism to enable the force applying means to move the pincers upwardly of the intermediate position to the pincers upper portion.

2. A pulling over and lasting arrangement comprising: a support for supporting bottom-down a shoe assembly that includes a last having an upper mounted thereon and an insole located on its bottom; means mounting the support for heightwise movement; a pair of wipers mounted for forward translatory movement from a rearward out-of-the-way position to a forward wipers working position and for forward and inward movement in a wiping stroke from the forward wipers working position; a pincers located outwardly of the support, movable between open and closed positions, mounted for heightwise movement; yieldable force applying means for effecting the heightwise movement of the pincers; means for initially retaining the support in a support lower position wherein the top of the support is below the tops of the wipers; means for initially retaining the wipers in their rearward out-of-the-way position; means for initially retaining the pincers in its open position; means for initially causing the force applying means to retain the pincers in a pincers upper position wherein the pincers are above the level of the wipers; means for thereafter moving the pincers into its closed position to grip the upper margin; means for thereafter causing the force applying means to lower the pincers to a pincers working position that is determined by the resistance to stretching of the upper margin and that is below the bottoms of the wipers; means for thereafter raising the support from the support lower position to a support upper position wherein the top of the support is approximately at the level of the tops of the wipers; means, operative after the force applying means has lowered the pincers to the pincers working position, to move the wipers to the wipers working position wherein the wipers are close to the periphery of the insole and are above the pincers; means for thereafter imparting a wiping stroke to the wipers to enable the wipers to wipe the upper margin against the insole; means, effective prior to the completion of the wiping stroke, for returning the pincers to its open position to enable the pincers to release the upper margin; means for thereafter moving the wipers rearwardly to return the wipers to their rearward out-of-the-way position wherein the wipers are not above the pincers; and means, effective when the wipers are no longer above the pincers, for causing the force applying means to raise the pincers to the pincers upper position; characterized in that the arrangement comprises: a locking mechanism, effective when the pincers is in the pincers working position, to lock the pincers against upward movement beyond an intermediate position below the level of the bottoms of the wipers that is between the pincers working position and the pincers upper position, the pincers in its intermediate position being lower than the level of the bottoms of the wipers; and release means effective, after the wipers have moved rearwardly so as to no longer be above the pincers, to release the locking mechanism to enable the force applying means to move the pincers upwardly of the intermediate position to the pincers upper position.

3. The pulling over arrangement of claim 1 or claim 2 comprising: a non-heightwise movable upper housing; and a lower housing, located below the upper housing, mounted to the pincers for heightwise movement therewith; characterized in that the locking mechanism comprises: a lever depending from the upper housing and so pivoted to the upper housing as to have inward-outward movement with respect to the lower housing; an upwardly facing shoulder on the lower housing; lever operating spring means yieldably urging the lever towards the lower housing; and a tooth on the lever so located as to bear against the lower housing below the shoulder when the pincers is in the pincers upper position and to be located above the shoulder when the pincers is in the pincers working position, the engagement of the tooth with the shoulder being determinative of said intermediate position; and characterized in that the release means comprises: latching means for latching the tooth in a latched position outwardly of the shoulder while the shoulder is below the tooth prior to causing the force applying means to move the pincers upwardly to the pincers upper position; and unlatching means for unlatching the tooth from said latched position so as to enable the lever operating spring means to urge the tooth against the lower housing when the pincers, together with the lower housing, has been raised by the force applying means sufficiently to raise the shoulder above the tooth.

4. The arrangement of claim 3 wherein the force applying means lowers the pincers downwardly of the pincers working position to a pincers lower position pursuant to the return of the pincers to the pincers upper position; characterized in that the aforementioned shoulder is a lower shoulder; and characterized in that the latching means and unlatching means comprise: an upper shoulder on the lower housing located above the lower shoulder; a leg depending from the upper housing and extending outwardly of the lever; a finger pivoted to the leg for heightwise movement and extending towards the lower housing, the finger and the lower housing being so constructed and arranged that the finger rests on the upper shoulder when the pincers is in the pincers upper position; finger operating spring means yieldably urging the finger downwardly against the upper shoulder; a recess in the bottom of the finger; a pin on the lever so constructed as to be seated in the recess when the pin and the recess are in alignment, the pin and the recess being so constructed and arranged that the pin is inward of the recess when the tooth is bearing against the lower housing; and a cam, mounted to the lever, and a cam follower, mounted to the lower housing, so constructed and arranged as to cause the cam and the cam follower to coact to swing the lever outwardly away from the lower housing in response to the lowering of the pincers to the pincers lower position and a corresponding lowering of the lower housing, the outward swinging of the lever enabling the pin to be seated in the recess and to be retained so seated by the finger operating spring means; the raising of the pincers to the pincers upper position and the corresponding raising of the lower housing causing the upper shoulder to engage the finger and swing the finger upwardly so as to raise the recess upwardly of the pin and thereby enable the lever operating spring means to again swing the lever inwardly so as to cause the tooth to bear against the lower housing below the lower shoulder.

* * * * *